US007811733B2

(12) United States Patent
Suwabe

(10) Patent No.: US 7,811,733 B2
(45) Date of Patent: Oct. 12, 2010

(54) ELECTROSTATIC LATENT IMAGE TONER, AND MANUFACTURE THEREOF, AND ELECTROSTATIC IMAGE DEVELOPER, AND IMAGE FORMING METHOD

(75) Inventor: Masaaki Suwabe, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 842 days.

(21) Appl. No.: 11/490,062

(22) Filed: Jul. 21, 2006

(65) Prior Publication Data

US 2007/0196757 A1 Aug. 23, 2007

(30) Foreign Application Priority Data

Feb. 20, 2006 (JP) ..... 2006-042390

(51) Int. Cl.
*G03G 9/00* (2006.01)

(52) U.S. Cl. ..... 430/108.4

(58) Field of Classification Search ..... 430/108.4
See application file for complete search history.

(56) References Cited

U.S. PATENT DOCUMENTS

| | | | |
|---|---|---|---|
| 5,476,741 | A | 12/1995 | Nishikiori et al. |
| 5,714,542 | A | 2/1998 | Niinae et al. |
| 6,120,967 | A | 9/2000 | Hopper et al. |
| 6,818,369 | B2 | 11/2004 | Sugiura et al. |
| 2001/0018158 | A1 | 8/2001 | Yoshida et al. |
| 2001/0033984 | A1 | 10/2001 | Matsumura et al. |
| 2002/0192587 | A1 | 12/2002 | Matsumura et al. |
| 2003/0194628 | A1 | 10/2003 | Yoshida et al. |
| 2003/0219666 | A1 | 11/2003 | Kitani et al. |
| 2004/0053154 | A1 | 3/2004 | Tomita et al. |
| 2004/0146795 | A1 | 7/2004 | Emoto et al. |
| 2004/0185361 | A1 | 9/2004 | Yoshino et al. |
| 2005/0064318 | A1 | 3/2005 | Shida et al. |
| 2005/0089784 | A1 | 4/2005 | Ohira et al. |
| 2005/0135844 | A1 | 6/2005 | Takenouchi et al. |
| 2006/0046178 | A1 | 3/2006 | Akiyama et al. |
| 2006/0154168 | A1 | 7/2006 | Tomita et al. |

FOREIGN PATENT DOCUMENTS

| | | |
|---|---|---|
| EP | 1 376 248 A1 | 1/2004 |
| JP | A 42-23910 | 11/1967 |
| JP | A 5-61260 | 3/1993 |
| JP | A-7-104514 | 4/1995 |
| JP | A-7-104515 | 4/1995 |
| JP | A 9-96925 | 4/1997 |
| JP | A 9-274338 | 10/1997 |

(Continued)

OTHER PUBLICATIONS

Masaaki Suwabi, et al. U.S. Appl. No. 11/438,155, filed May 22, 2006.

(Continued)

*Primary Examiner*—Mark A Chapman
(74) *Attorney, Agent, or Firm*—Oliff & Berridge, PLC

(57) ABSTRACT

An electrostatic latent image toner in which the quantity within the toner of alkyl carboxylate esters formed from a carboxylic acid containing from approximately 3 to 5 carbon atoms and an alkyl group containing from approximately 3 to 5 carbon atoms is no more than approximately 4 ppm.

17 Claims, 1 Drawing Sheet

FOREIGN PATENT DOCUMENTS

| | | |
|---|---|---|
| JP | A 9-297429 | 11/1997 |
| JP | A 11-002922 | 1/1999 |
| JP | A 2001-255703 | 9/2001 |
| JP | A 2002-131977 | 5/2002 |
| JP | A 2003-228192 | 8/2003 |
| JP | A-2004-20805 | 1/2004 |
| JP | A 2004-46131 | 2/2004 |
| JP | A 2004-054256 | 2/2004 |
| JP | A 2004-226445 | 8/2004 |
| JP | A 2005-70606 | 3/2005 |
| JP | A 2005-84468 | 3/2005 |
| JP | A 2005-91840 | 4/2005 |
| JP | A 2005-173305 | 6/2005 |
| JP | A 2005-301047 | 10/2005 |

OTHER PUBLICATIONS

Sep. 10, 2009 Office Action for U.S. Appl. No. 11/438,155, 16 pgs.

Mar. 5, 2010 Office Action issued in copending U.S. Appl. No. 11/438,155.

Jun. 15, 2010 Japanese Notice of Grounds for Rejection issued in Japanese Application No. 2006-042390 (w/English translation).

Jul. 27, 2010 Japanese Office Action issued in Japanese Patent Application No. 2005-339344 (with translation).

ELECTROSTATIC LATENT IMAGE TONER, AND MANUFACTURE THEREOF, AND ELECTROSTATIC IMAGE DEVELOPER, AND IMAGE FORMING METHOD

BACKGROUND

1. Technical Field

The present invention relates to a method of manufacturing an electrostatic latent image toner that is used for developing an electrostatic latent image in an electrophotographic device that uses an electrophotographic process, such as a copying machine, printer, or facsimile, and also relates to the toner, an electrostatic image developer that uses the toner, and an image forming method.

2. Related Art

Generally, an image is formed via multiple steps, including electrically forming a latent image, using any of a variety of techniques, on the surface of a photoreceptor (latent image holding member) that uses a photoconductive material, developing the formed latent image using a toner, thereby forming a toner image, transferring this toner image, via an intermediate transfer material in some cases, to the surface of a transfer target such as a piece of paper, and fixing the toner by heating, pressure application, heated pressure application, or a solvent vapor method. Any residual toner on the photoreceptor surface is then cleaned as necessary, using any of a variety of methods, and the photoreceptor is then reused for the development of the next toner image.

Known characteristics that are required of the developer in order to form a stable toner image over an extended period include various material properties and the particle size distribution of either the toner, or in the case of a two-component developer the carrier, used in forming the developer. By adjusting these characteristics to obtain a developer that exhibits a suitable charge quantity and charge distribution, favorable developer characteristics can be obtained, meaning toner can be used to develop the latent image, whereas toner does not adhere to the non-latent image.

Usually, toner develops a friction charge with a charge member, such as the developing sleeve in the case of a one-component developing system or the carrier in the case of a two-component developing system, and should exhibit a suitable charge quantity and charge distribution. If the charge quantity is overly large, then because the adhesive force between the toner and the charge member exceeds the force that causes development of the latent image onto the photoreceptor, developing does not occur, resulting in low density of the printed image. In contrast if the charge quantity is too small, then toner can adhere to areas of the photoreceptor outside of the latent image, causing so-called fogging.

Accordingly, it is well known that a toner should be imparted with a suitable charge quantity and a narrow charge distribution.

However, even if the level of volatile components contained within the toner particles is controlled, the problems of deterioration in the charge quantity and charge distribution of the electrostatic image developer are not necessarily resolved completely.

SUMMARY

As a result of intensive investigation aimed at addressing the problems described above, the inventors of the present invention were able to complete the present invention described below.

(1) According to an aspect of the present invention, there is provided an electrostatic latent image toner, wherein the quantity within the toner of alkyl carboxylate esters formed from a carboxylic acid containing from approximately 3 to 5 carbon atoms and an alkyl group containing from approximately 3 to 5 carbon atoms is no more than approximately 4 ppm.

BRIEF DESCRIPTION OF THE DRAWINGS

Embodiment(s) of the present invention will be described in detail based on the following figures, wherein.

DETAILED DESCRIPTION

Figure 1:
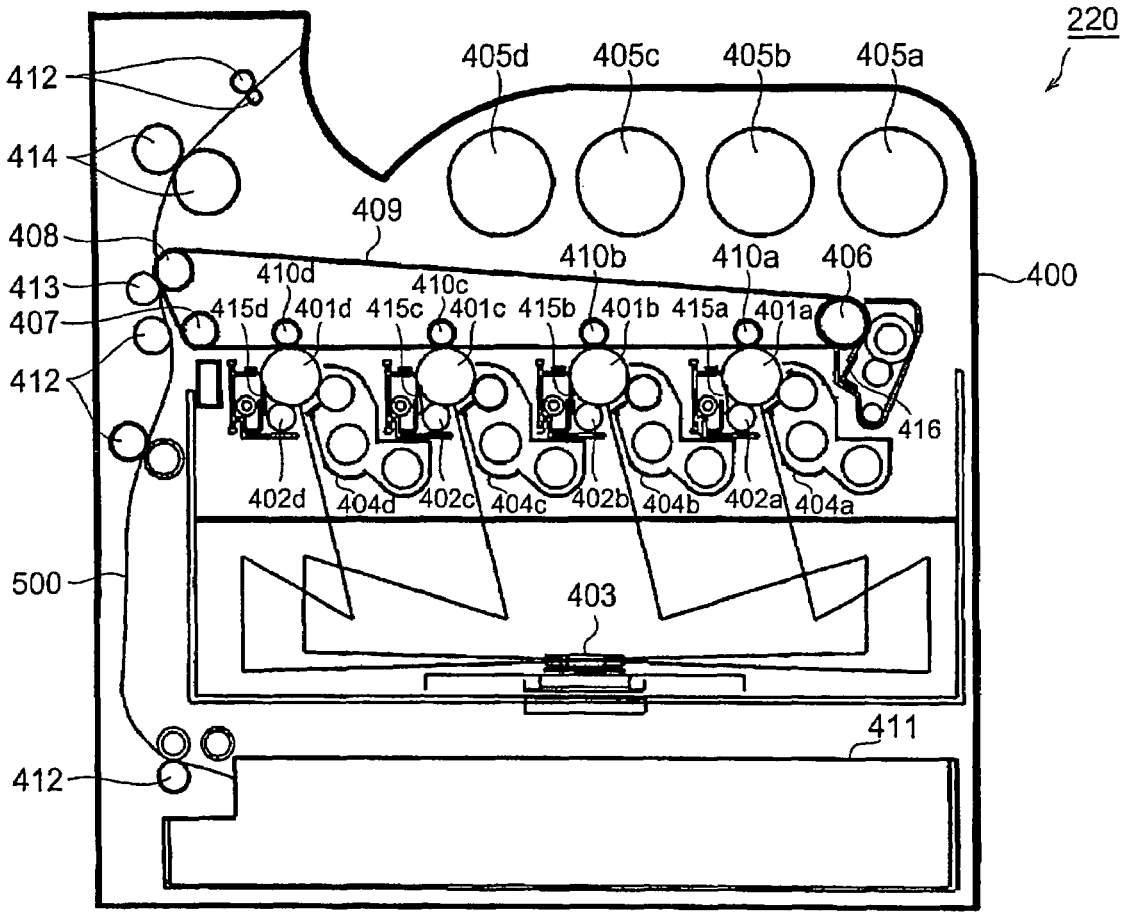
FIG. 1 is an explanatory diagram showing an example of an electrophotographic image formation apparatus that includes an electrophotographic photoreceptor of the present invention.

As follows is a description of exemplary embodiments of the present invention.

In the following description, the present invention is broadly classified into sequential sections relating to a method of manufacturing an electrostatic latent image toner, an electrostatic latent image toner, and an electrostatic image developer.

In the electrostatic latent image toner of the present invention (hereafter also abbreviated as simply "toner"), attention is focused on the quantity of alkyl carboxylate esters contained within the toner. More specifically, saturated alkyl carboxylate esters formed from a saturated carboxylic acid containing from 3 to 5 carbon atoms and an alkyl group containing from 3 to 5 carbon atoms have low volatility, and are not solid even at normal temperatures. Furthermore, because they contain no unsaturated bonds, they do not participate in polymerization. In other words, whereas removal of these esters is extremely difficult, they exhibit high solubility in resins, and even if the quantity contained within the toner is small, the effect of these esters over time is significant.

By either removing, or restricting the quantity of these saturated alkyl carboxylate esters, the present invention enables the production of a toner that is capable of realizing favorable stability in the charge quantity and the charge distribution over extended periods.

Examples of saturated carboxylic acids containing from 3 to 5 carbon atoms include propionic acid, butyric acid, isobutyric acid, valeric acid, isovaleric acid, methylethylacetic acid, and pivalic acid, whereas examples of alkyl groups containing from 3 to 5 carbon atoms include propyl, butyl, isobutyl, pentyl, isopentyl, and neopentyl groups. Of these, control of the quantities of esters of propionic acid and isobutyric acid with butyl and isobutyl groups is particularly desirable, owing to their high level of solubility and the difficulty associated with their removal.

It is thought that these saturated alkyl carboxylates formed from a carboxylic acid containing from 3 to 5 carbon atoms and an alkyl group containing from 3 to 5 carbon atoms are synthesized, for example in the case of butyl propionate, during synthesis of the corresponding unsaturated carboxylate, namely butyl acrylate. In particular, these carboxylates are thought to be generated by oxidation during syntheses that involve conversion of propylene into acrolein, oxidation of acrolein to synthesize acrylic acid, and subsequent esterification, or through degradation of the polymerization inhibitors typically added following synthesis, or as a result of oxidation during polymerization.

<Method of Manufacturing Electrostatic Latent Image Toner>

Examples of methods of manufacturing an electrostatic latent image toner of the present invention (hereafter also abbreviated as simply "toner") include the manufacturing methods described below.

A method of manufacturing toner includes: bringing a polymerizable monomer having a vinyl-based double bond into contact with a porous material; and producing a resin particle dispersion by polymerizing, in a water-based solvent, a polymerizable monomer that includes the polymerizable monomer having a vinyl-based double bond, wherein the resin particle dispersion, a colorant particle dispersion produced by dispersing a colorant, and a release agent particle dispersion produced by dispersing a release agent are mixed together, and following the formation of aggregate particles through aggregation of the resin particles, the colorant particles and the release agent particles, heating is conducted to fuse the aggregate particles and produce the electrostatic latent image toner.

Examples of materials that can be used as the above porous material include activated carbons such as granulated activated carbon generated using coconut husk as a raw material, silica gels, zeolites, and molecular sieves (a registered trademark of Linde Co.). There are a variety of these molecular sieves including 4A, 5A, and 13X, and these numbers represent the respective pore sizes (Å). Furthermore, the activated carbons typically have an internal specific surface area within a range from 1,000 to 3,000 $m^2/g$, and the silica gels typically have a specific surface area of approximately 500 $m^2/g$. Furthermore, amongst the various zeolites, synthetic zeolites are particularly widely used as molecular sieves.

Molecular sieves are particularly resistant to degradation in organic solvents, and are ideal for separating carbon-based materials such as hydrocarbons and the like. Accordingly, when a molecular sieve is used as the porous material, and brought into contact with the polymerizable monomer having a vinyl-based double bond, saturated alkyl carboxylate esters formed from a carboxylic acid containing from 3 to 5 carbon atoms and an alkyl group containing from 3 to 5 carbon atoms, which are incorporated within the polymerizable monomer having a vinyl-based double bond and are subsequently incorporated within the toner, can be selectively adsorbed within the pores of the molecular sieve. As a result, the polymerizable monomer having a vinyl-based double bond and the saturated alkyl carboxylate esters are substantially separated, and following this contact with the molecular sieve, the polymerizable monomer having a vinyl-based double bond is washed. For example, in those cases where the saturated alkyl carboxylate ester is a saturated alkyl carboxylate containing from 3 to 5 carbon atoms (such as butyl propionate, propyl butyrate, or butyl isobutyrate) derived from an unsaturated carboxylate ester such as an alkyl acrylate or alkyl methacrylate that functions as the polymerizable monomer having a vinyl-based double bond, the pore size of the above porous material is preferably within a range from 4 to 5 Å. As described above, saturated alkyl carboxylates containing from 3 to 5 carbon atoms such as alkyl propionates are incorporated within the polymerizable monomers that act as the raw materials for resin synthesis, do not participate in the polymerization reaction, and exhibit minimal solubility in water, and as a result, remain within the resin particles during the manufacture of conventional resin particle dispersions. However, as described above, by bringing the polymerizable monomer into contact with a porous material prior to the polymerization reaction, these impurities can be removed from the polymerizable monomer, meaning the danger of the aforementioned saturated alkyl carboxylate esters remaining within the resin particles of the resin particle dispersion can be almost completely avoided.

Examples of suitable methods of achieving the aforementioned contact of the organic solvent include, for example, methods in which the porous material is immersed for a predetermined period within the aforementioned polymerizable monomer having a vinyl-based double bond, and methods in which the polymerizable monomer having a vinyl-based double bond is passed through a column packed with the porous material, and an appropriate method should be selected in accordance with the quantity of impurities incorporated within the polymerizable monomer having a vinyl-based double bond.

The weight ratio between the porous material and the polymerizable monomer having a vinyl-based double bond is preferably within a range from 1:100 to 30:70. If the weight ratio falls outside this range and the quantity of the porous material is too large, then when the porous material and the polymerizable monomer having a vinyl-based double bond are separated by filtration, the quantity of the polymerizable monomer having a vinyl-based double bond adhered to the surface of the porous material becomes overly large, causing an uneconomic reduction in the quantity required of the polymerizable monomer. In contrast if the weight ratio falls outside the above range and the quantity of the porous material is too small, then the saturated alkyl carboxylate esters formed from a carboxylic acid containing from 3 to 5 carbon atoms and an alkyl group containing from 3 to 5 carbon atoms cannot be adequately removed by adsorption, meaning the toner of the final product does not adequately exhibit the effects of the present invention.

An example of a method of manufacturing the above electrostatic latent image toner is an emulsion polymerization aggregation method. An emulsion polymerization aggregation method is a manufacturing method that includes: preparing an aggregate particle dispersion by forming aggregated particles within a dispersion containing at least dispersed resin particles (an aggregation step), and heating the aggregate particle dispersion to fuse the aggregate particles (a fusion step) (hereafter this manufacturing method is also referred to as an "aggregation fusion method").

Furthermore, a step of forming adhered particles by adding a resin particle dispersion containing dispersed resin particles to the aggregate particle dispersion and conducting mixing, thereby causing the resin particles to adhere to the aggregate particles (an adhesion step) may also be provided between the aggregation step and the fusion step.

This adhesion step is a step of forming adhered particles by adding and mixing the above resin particle dispersion with the aggregate particle dispersion prepared in the above aggregation step, thereby causing the resin particles to adhere to the aggregate particles, and because the added resin particles correspond with particles that have been added to the aggregate particles, in the present description, these resin particles may also be referred to as "addition particles". Besides the resin particles described above, other examples of these addition particles include release agent particles and colorant particles and the like, which may be used either alone, or in combinations of a multiple of different particles. There are no particular restrictions on the method of adding and mixing the resin particle dispersion, and the dispersion may be either added gradually in a continuous manner, or added in a stepwise fashion using multiple repetitions. By adding and mixing the above resin particles (addition particles) in this manner, the generation of very fine particles is suppressed, enabling a sharp particle size distribution to be achieved for the resulting electrostatic latent image toner, which contributes to a higher quality image. Furthermore, by providing the adhesion step described above, a pseudo shell structure can be formed, enabling the exposure of internal additives such as colorants and release agents at the toner surface to be reduced. This results in various advantages, including enabling improvements in the chargeability and lifespan of the toner, enabling the particle size distribution to be better maintained, with better suppression of fluctuations in the distribution, during the fusion process within the fusion step, thereby either removing the necessity for the addition of surfactants or stabilizers such as bases or acids to enhance the stability during fusion, or enabling the quantities added of such materials to be minimized, as well as reducing costs and enabling improvements in the product quality. Accordingly, when a release agent is used, the addition of addition particles that contain mainly resin particles is preferred.

If this type of method is used, then the shape of the toner particles can be controlled by appropriate adjustment of conditions such as the temperature, stirring speed and pH during the fusion step. Following completion of the fusion-particle formation step, the toner particles are washed and dried to yield the product toner. In terms of the chargeability of the toner, the toner particles are preferably subjected to thorough displacement washing with ion-exchanged water, and the degree of washing is typically monitored via the conductivity of the filtrate. A step of neutralizing ions with either an acid or a base during the washing process may also be included. Furthermore, although there are no particular restrictions on the method used for conducting the solid-liquid separation following washing, from the viewpoint of productivity, methods such as suction filtration or pressure filtration are favorable. Moreover, although there are also no particular restrictions on the method using for drying the toner, from the viewpoint of productivity, methods such as freeze-drying, flash jet drying, fluidized drying, and vibrating fluidized drying are favorable.

The resin particles used in the electrostatic latent image toner are formed from thermoplastic polymers that act as a binding resin, and specific examples include homopolymers of the polymerizable monomer having a vinyl-based double bond described above, including styrene compounds such as styrene, para-chlorostyrene and α-methylstyrene, esters having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, n-butyl methacrylate, lauryl methacrylate, 2-ethylhexyl methacrylate, n-propyl crotonate, n-butyl crotonate, and ethyl tiglate, vinyl nitriles such as acrylonitrile and methacrylonitrile, vinyl ethers such as vinyl methyl ether and vinyl isobutyl ether, vinyl ketones such as vinyl methyl ketone, vinyl ethyl ketone and vinyl isopropenyl ketone, and olefins such as ethylene, propylene and butadiene, as well as copolymers or mixtures obtained by combining two or more of the above monomers, non-vinyl condensation resins such as an epoxy resin, polyester resin, polyurethane resin, polyamide resin, cellulose resin, polyether resin, or a mixture thereof with an above vinyl-based resin, and graft polymers obtained by polymerizing a vinyl-based monomer in the presence of one of the above polymers. These resins may be used either alone, or in combinations of two or more different resins. Of these resins, vinyl-based resins are particularly preferred. The use of a vinyl-based resin offers the advantage that the resin particle dispersion can be prepared with comparative ease by conducting an emulsion polymerization or a seed polymerization using an ionic surfactant or the like.

There are no particular restrictions on the method of preparing the dispersion of the above resin particles, and any method suitable for the purpose can be employed. For example, the dispersion can be prepared in the manner described below.

In those cases where the resin of the resin particles is either a homopolymer of a vinyl-based monomer such as an aforementioned ester having a vinyl group or an aforementioned vinyl nitrile, vinyl ether or vinyl ketone, or a copolymer thereof (a vinyl-based resin), then by subjecting the vinyl-based monomer to emulsion polymerization or seed polymerization or the like within an ionic surfactant, a dispersion can be prepared in which the resin particles formed from the homopolymer or copolymer (vinyl-based resin) of the vinyl-based monomer are dispersed within the ionic surfactant. In those cases where the resin of the resin particles is a resin other than a homopolymer or copolymer of an aforementioned vinyl-based monomer, provided the resin dissolves in an oil-based solvent that exhibits comparatively low solubility in water, a dispersion can be prepared by dissolving the resin in this oil-based solvent, adding the resulting solution to water together with the above ionic surfactant and a polymer electrolyte, dispersing the resulting mixture to generate a particle dispersion using a dispersion device such as a homogenizer, and then evaporating off the oil-based solvent either by heating or under reduced pressure. In those cases where the resin particles dispersed within the resin particle dispersion are composite particles that include components other than the resin particles, the dispersion containing these dispersed composite particles can be prepared, for example, in the manner described below. For example, preparation can be conducted by a method in which each of the components of the composite particles are dissolved or dispersed within a solvent, and then in a similar manner to that described above, the resulting solution or dispersion is dispersed in water together with an appropriate dispersion agent, and then either heated or placed under reduced pressure to remove the solvent, or a method in which the surface of a latex prepared by emulsion polymerization or seed polymerization is solidified by conducting either mechanical shearing or electrical adsorption.

The volume center diameter (median diameter) of the resin particles is typically no greater than 1 μm, preferably within a range from 50 to 400 nm, and even more preferably from 70 to 350 nm. If the average volume particle size of the resin particles is large, then the particle size distribution of the final product electrostatic latent image toner broadens, which leads to the generation of free particles, and a resulting deterioration in the performance and reliability of the toner. In contrast, if the average volume particle size is too small, then the solution viscosity increases considerably during toner production, which can also cause the particle size distribution of the final product toner to broaden. Provided the volume average particle size of the resin particles falls within the above range, not only can the above drawbacks be avoided, but other advantages are also realized, including a reduction in uneven distribution within the toner, more favorable dispersion within the toner, and less variation in the performance and reliability of the toner. The average particle size of the resin particles can be measured using, for example, a Doppler scattering particle size distribution analyzer (Microtrac UPA9340, manufactured by Nikkiso Co., Ltd.).

There are no particular restrictions on the colorants used in exemplary embodiments of the present invention, and any conventional colorant can be used. Suitable examples include carbon blacks such as furnace black, channel black, acetylene black and thermal black, inorganic pigments such as red iron oxide, iron blue and titanium oxide, azo pigments such as fast yellow, disazo yellow, pyrazolone red, chelate red, brilliant carmine and para brown, phthalocyanine pigments such as copper phthalocyanine and metal-free phthalocyanine, and condensed polycyclic pigments such as flavanthrone yellow, dibromoanthrone orange, perylene red, quinacridone red and dioxazine violet.

Furthermore, various pigments such as chrome yellow, hansa yellow, benzidine yellow, threne yellow, quinoline yellow, permanent orange GTR, pyrazolone orange, vulkan orange, watchung red, permanent red, DuPont oil red, lithol red, rhodamine B lake, lake red C, rose bengal, aniline blue, ultramarine blue, calco oil blue, methylene blue chloride, phthalocyanine blue, phthalocyanine green, malachite green oxalate, C.I. Pigment Red 48:1, C.I. Pigment Red 122, C.I. Pigment Red 57:1, C.I. Pigment Yellow 12, C.I. Pigment Yellow 97, C.I. Pigment Yellow 17, C.I. Pigment Blue 15:1 and C.I. Pigment Blue 15:3, or various dyes can also be used, and these may be used either alone, or in combinations of two or more different colorants.

These colorants can be used alone, in mixtures, or as solid solutions. These colorants can be dispersed within the dispersion using conventional methods, and examples of particularly favorable dispersion devices include a revolving shearing homogenizer, media dispersers such as a ball mill, sand mill or attritor, and a high pressure counter collision type disperser. The particle size of the resulting colorant particle dispersion is measured, for example, using a laser diffraction particle size distribution analyzer (LA-700, manufactured by Horiba, Ltd.). The center diameter (median diameter) of the colorant particles within a toner of the present invention is measured using a transmission electron microscope (TEM), and values within a range from 100 to 330 nm are preferred.

The colorant content within a toner according to an exemplary embodiment of the present invention, reported as a solid fraction equivalent per 100 parts by weight of the resin, is typically within a range from 1 to 20 parts by weight. If a magnetic material is used as a black colorant, then unlike other colorants, the colorant content is typically within a range from 30 to 100 parts by weight.

Furthermore, in those cases where the toner is used as a magnetic toner, a magnetic powder may be included in the toner. This magnetic powder is a substance that is magnetized in a magnetic field, and suitable examples include ferromagnetic powders such as iron, cobalt and nickel, as well as compounds such as ferrite and magnetite. In the present invention, because the toner is produced within an aqueous phase, particular attention should be paid to the ability of the magnetic material to migrate into the aqueous phase, and the surface of the magnetic material is preferably modified by conducting a hydrophobic treatment or the like.

A release agent used in an exemplary embodiment of the present invention should be a substance with a subjective maximum endothermic peak, measured in accordance with ASTM D3418-8, within a range from 60 to 120° C., and a melt viscosity at a temperature of 140° C. within a range from 1 to 50 mPas. If the melting temperature is less than 60° C., then the release agent transition temperature is too low, the anti-blocking characteristics deteriorate, and the developing characteristics worsen when the temperature inside the copying machine increases. In contrast, if the melting temperature exceeds 120° C., then the release agent transition temperature is too high, meaning the toner is unable to satisfy recent demands for low-temperature fixing, and the process is also undesirable in terms of energy conservation. Furthermore, at melt viscosities higher than 50 mPas, elution of the release agent from the toner weakens, causing inadequate fixing releasability that results in irregularities in the gloss of the fixed image. The viscosity of a release agent of the present invention is measured using an E-type viscometer. During measurement, an E-type viscometer fitted with an oil circulating constant temperature bath (manufactured by Tokyo Keiki Co., Ltd.) is used. Measurements are conducted using a cone plate-cup combination plate with a cone angle of 1.34 degrees. The sample is placed inside the cup, and with the temperature of the circulation device set to 140° C., an empty measuring cup and cone are set in the measuring device, and a constant temperature is then maintained while the oil is circulated. Once the temperature has stabilized, 1 g of the sample is placed inside the measuring cup, and is then allowed to stand for 10 minutes with the cone in a stationary state. Following stabilization, the cone is rotated and the measurement is performed. The cone rotational speed is set to 60 rpm. This measurement is conducted three times, and the average of those three values is recorded as the viscosity $\eta$.

It is desirable that the release agent exhibits an endothermic initiation temperature in the DSC curve measured using a differential scanning calorimeter of at least 40° C. Temperatures of 50° C. or higher are particularly preferred. If this endothermic initiation temperature is lower than 40° C., then aggregation of the toner may occur within the copying machine or inside the toner bottle. The endothermic initiation temperature refers to the temperature at which the quantity of heat absorbed by the release agent begins to change as the temperature is increased. The endothermic initiation temperature varies depending on the nature of the low molecular weight fraction within the molecular weight distribution that constitutes the release agent, as well as the nature and quantity of polar groups within that low molecular weight fraction. Generally, if the molecular weight is increased, then the endothermic initiation temperature increases together with the melting temperature, but this results in a loss of the inherent low melting temperature and low viscosity of the release agent. Accordingly, selective removal of this low molecular weight fraction from the molecular weight distribution of the release agent is a more effective solution, and suitable methods of achieving this removal include molecular distillation, solvent fractionation, and gas chromatographic separation. DSC measurements can be conducted, for example, using a DSC-7 manufactured by PerkinElmer Inc. In this device, temperature correction at the detection portion is conducted using the melting temperatures of indium and zinc. Correction of the heat quantity is conducted using the heat of fusion of indium. The sample is placed in an aluminum pan, and using an empty pan as a control, measurement is conducted from room temperature at a rate of temperature increase of 10° C./minute, using a measurement sample size of 50 mg. Specific examples of suitable release agents include low molecular weight polyolefins such as polyethylene, polypropylene and polybutene, silicones that exhibit a softening temperature under heating, fatty acid amides such as oleyl amide, erucyl amide, ricinoleyl amide and stearyl amide, vegetable waxes such as carnauba wax, rice wax, candelilla wax, Japan wax and jojoba oil, animal waxes such as beeswax, mineral or petroleum waxes such as montan wax, ozokerite, ceresin, paraffin wax, microcrystalline wax and Fischer-Tropsch wax, ester waxes such as fatty acid esters, montanate esters and carboxylate esters, as well as modified products thereof. These release agents may be used either alone, or in combinations of two or more different materials.

The quantity of the above release agent added to the toner is typically within a range from 5 to 40% by weight, and is preferably from 5 to 20% by weight. If the quantity of the release agent is too small then the fixing characteristics may deteriorate, whereas if the quantity is too large, the toner powder characteristics may worsen, and problems such as photoreceptor filming may occur.

Of the materials described above, release agents that can be classified as polyalkylenes, and which exhibit a maximum endothermic peak, as determined using a differential scanning calorimeter (DSC-7 manufactured by PerkinElmer Inc.), of 75 to 95° C., and a melt viscosity at 140° C. of 1 to 10 mPas are particularly desirable. Furthermore, the quantity of this polyalkylene within a magenta toner is preferably from 6 to 9% by weight. If the melting temperature of the above release agent is too low (in other words, if the maximum endothermic peak is too low), or the quantity added of the release agent is too large, then the strength at the interface between the toner and the paper may decrease. If the melting temperature of the release agent is too high (in other words, if the endothermic peak is too high), then elution of the release agent to the image surface is insufficient in terms of ensuring a favorable level of image preservation. If the viscosity of the release agent is too low, the strength of the toner layer may deteriorate, whereas if the viscosity is too high, elution of the release agent to the image surface is insufficient in terms of ensuring a favorable level of image preservation. In this description, the above term "polyalkylene" refers to polymers with a number average molecular weight of no more than 1,200 produced by the addition polymerization of a polymerizable monomer represented by a formula $C_nH_{2n}$, (wherein, n is a natural number of at least 2 but no more than 4), such as polyethylene, polypropylene and polybutene.

The above release agent is dispersed in water together with an ionic surfactant and a polymer electrolyte such as a polymeric acid or polymeric base, heated to a temperature at least as high as the melting temperature, and then dispersed to a fine particle form using a homogenizer or pressure discharge disperser (Gaulin Homogenizer, manufactured by Gaulin, Inc.) capable of imparting a powerful shearing force, thereby forming a dispersion.

The dispersion average particle size D50 for the above release agent dispersion is preferably within a range from 180 to 350 nm, and is even more preferably from 200 to 300 nm. Furthermore, it is desirable that coarse powders of 600 nm or larger do not exist. If the dispersion average particle size is too small, then the level of elution of the release agent on fixing may be insufficient, and the hot offset temperature may decrease, whereas if the average particle size is too large, then the release agent may be exposed at the toner surface causing a deterioration in the powder characteristics, and photoreceptor filming may occur. Furthermore, if a coarse powder exists, then incorporating the coarse powder into the toner using a wet production method becomes difficult, meaning free release agent is generated, which can cause contamination of the developing sleeve or photoreceptor. The dispersion particle size can be measured using a Doppler scattering particle size distribution analyzer (Microtrac UPA9340, manufactured by Nikkiso Co., Ltd.).

In the release agent used in a toner of an exemplary embodiment of the present invention, the proportion of dispersant relative to the release agent within the release agent dispersion should be at least 1% by weight and no more than 20% by weight. If the proportion of the dispersant is too low, the release agent may not be able to be dispersed satisfactorily, causing a deterioration in the storage stability. If the proportion of the dispersant is too high, then the charge characteristics of the toner, and particularly the environmental stability, may deteriorate.

In the above transmission electron microscope observation of the toner, the release agent preferably includes rod-shaped particles, and in terms of achieving favorable elution of the release agent, and ensuring favorable fixing and transparency, the volume average particle size of these rod-shaped particles is preferably within a range from 200 to 1,500 nm. Sizes from 250 nm to 1,000 nm are particularly desirable. If the size is less than 200 nm, then even if melting occurs during fixing, adequate elution may still not be achieved, resulting in unsatisfactory image preservation. In contrast, if the size exceeds 1,500 nm, then crystalline particles that are of a size within the visible light range may remain within the image or on the image surface following fixing, causing a deterioration in the transparency relative to transmission light. These rod-shaped release agent particles preferably account for at least 75% of the release agent within the toner.

Inorganic or organic particles may also be added to a toner of an exemplary embodiment of the present invention. The reinforcing effect of these particles can improve the storage elastic modulus of the toner, and may also improve the anti-offset characteristics and the releasability from the fixing device. Furthermore, these particles may also improve the dispersibility of internal additives such as the colorant and release agent. Examples of suitable inorganic particles, which may be used either alone or in combination, include silica, hydrophobic-treated silica, alumina, titanium oxide, calcium carbonate, magnesium carbonate, tricalcium phosphate, colloidal silica, alumina-treated colloidal silica, cation surface-treated colloidal silica and anion surface-treated colloidal silica, and of these, in terms of achieving favorable transparency and dispersibility within the toner, the use of colloidal silica is particularly desirable. The volume average particle size of these particles is preferably within a range from 5 to 50 nm. Furthermore, combinations of particles of different sizes may also be used. Although the above particles may be added directly during production of the toner, in order to improve the dispersibility, the use of a dispersion that has been produced in advance by using an ultrasound disperser or the like to disperse the particles in an aqueous medium such as water, is preferred. In this dispersion, an ionic surfactant and a polymeric acid or polymeric base may also be used to further improve the dispersibility.

In the aggregation fusion method described above, a coagulant may also be added to effect aggregation of the resin particles and colorant particles and the like. The coagulant is produced by dissolving a typical inorganic metal compound or polymer thereof in a resin particle dispersion. The metal element that constitutes the inorganic metal salt may be any metal with an electric charge of 2 or greater that belongs to group 2A, 3A, 4A, 5A, 6A, 7A, 8, 1B, 2B, or 3B of the periodic table (extended periodic table) and dissolves in ionic form within the resin particle aggregate system. Specific examples of favorable inorganic metal salts include metal salts such as calcium chloride, calcium nitrate, barium chloride, magnesium chloride, zinc chloride, aluminum chloride and aluminum sulfate, and inorganic metal salt polymers such as polyaluminum chloride, polyaluminum hydroxide and polycalcium sulfide. Of these, aluminum salts and polymers thereof are particularly desirable. Generally, in order to achieve a sharper particle size distribution, divalent inorganic metal salts are more desirable than monovalent salts, trivalent or higher metal salts are more desirable than divalent salts, and for the same valency, an inorganic metal salt polymer is more desirable than the basic salt. Because the viscoelasticity of the toner can be controlled by altering the cohesive force between materials through appropriate control of the valency and quantity of the coagulant, the toner of the present invention preferably includes an added coagulant. These coagulants may be used either alone, or in combinations of two or more different compounds.

A toner of an exemplary embodiment of the present invention preferably has a shape factor SF1 within a range from 115 to 140. If this shape factor SF1 is less than 115, the adhesive force between toner particles weakens, increasing the likelihood of spattering during transfer. If the SF1 value exceeds 140, then the transferability of the toner may deteriorate, and the density of the developed toner image may decrease. In this description, the shape factor SF1 is represented by a formula: $SF1=(ML^2/A)\times(\pi/4)\times100$ (wherein, ML represents the absolute maximum length of a toner particle, and A represents the projected area of the toner particle). SF1 is converted to numerical form mainly by analyzing a microscope image or a scanning electron microscope (SEM) image using an image analyzer, and for example, can be calculated in the manner described below. Namely, an optical microscope image of a toner scattered on a slide glass is loaded into a Luzex image analyzer via a video camera, the maximum lengths and projected areas of at least 200 toner particles are determined, the shape factor is calculated for each particle using the above formula, and the average value of these shape factor values is then determined. In other words, the shape factor SF1 in the present invention is calculated by analyzing an image observed through an optical microscope using a Luzex image analyzer.

Other conventional materials such as charge control agents may also be added to a toner of an exemplary embodiment of the present invention. In such cases, the volume average particle size of the added materials should be no greater than 1 μm, and particles sizes within a range from 0.01 to 1 μm are preferred. If this volume average particle size exceeds 1 μm, then the particle size distribution of the final product electrostatic latent image developing toner broadens, free particles are generated, and the performance and reliability of the toner become prone to deterioration. In contrast, if the above volume average particle size falls within the above range, then not only can the above drawbacks be avoided, but other advantages are also realized, including a reduction in uneven distribution within the toner, more favorable dispersion within the toner, and less variation in the performance and reliability of the toner. The volume average particle size can be measured, for example, using a Microtrac or the like.

There are no particular restrictions on the device used for preparing dispersions of the various additives described above, and suitable devices include a revolving shearing homogenizer, devices that utilize media such as a ball mill, sand mill or dyno mill, as well as other conventional dispersers such as those used in the preparation of the colorant dispersion and the release agent dispersion, and the most appropriate device can be selected in each case.

Furthermore, the absolute value of the charge quantity of a toner of an exemplary embodiment of the present invention is preferably within a range from 10 to 70 μC/g, and charge quantities from 15 to 50 μC/g are particularly desirable. If the charge quantity is less than 10 μC/g, background staining becomes more likely, whereas if the charge quantity exceeds 70 μC/g, there is an increased likelihood of a decrease in image density. Furthermore, the ratio between the charge quantity under high humidity conditions at 30° C. and 80% RH, and the charge quantity under low humidity conditions at 10° C. and 20% RH is preferably within a range from 0.5 to 1.5, and is even more preferably from 0.7 to 1.2. If this ratio falls within the above range, then a crisp image can be obtained regardless of the environment. Although the contribution of external additives to this ratio is considerable, needless to say, the charge quantity with no external additives is also important. In order to improve the charge quantity and the environmental ratio for the charge quantity with no external additives, the acid value for the main resin is typically within a range from 5 to 50 mgKOH/g, and preferably from 10 to 40 mgKOH/g. Evaluation of the acid value of the binder is conducted in accordance with the potential difference titration method of JIS K 0070:92. The titration solution was a potassium hydroxide ethanol solution. Furthermore, it is desirable to reduce the total quantity of surfactants used in the colorant dispersion and the release agent dispersion and the like, and also to thoroughly wash out any residual surfactants and ions and the like, and accordingly, washing is preferably conducted until the conductivity of the wash filtrate reaches a value of no more than 0.01 mS/cm. Moreover, drying of the toner is also desirable, and drying is preferably conducted until the moisture content of the toner reaches a value of no more than 0.5% by weight.

In addition, the molecular weight distribution for a toner of an exemplary embodiment of the present invention, represented by the ratio (Mw/Mn) between the weight average molecular weight (Mw) and the number average molecular weight (Mn) measured by gel permeation chromatography, is preferably within a range from 2 to 30, even more preferably from 2 to 20, and is most preferably from 2.3 to 5. If the molecular weight distribution represented by this ratio (Mw/Mn) exceeds 30, then the light transmittance and coloration properties of the toner are unsatisfactory, and particularly in those cases where the electrostatic latent image developing toner is developed or fixed onto a film, the image projected upon light transmission is either ill-defined and dark, or lacking in color due to inadequate light transmittance. If the ratio (Mw/Mn) is less than 2, then the fall in toner viscosity during high temperature fixing becomes marked, making the toner prone to the offset phenomenon. In contrast, if the molecular weight distribution represented by this ratio (Mw/Mn) falls within the above numerical range, then not only are the light transmittance and coloration properties favorable, but decreases in the viscosity of the electrostatic latent image toner during high temperature fixing can be prevented, enabling effective suppression of the offset phenomenon.

Inorganic particles and organic particles which function as flowability assistants, cleaning assistants or abrasive agents may also be added to the final toner obtained by heating the toner produced in the manner described above. Examples of these inorganic particles include all those particles that are typically used as external additives for the toner surface, such as silica, alumina, titania, calcium carbonate, magnesium carbonate, tricalcium phosphate and cerium oxide. These inorganic particles are used for controlling various toner properties such as the chargeability, the powder characteristics and the storage characteristics, as well as for controlling system applicability properties such as the developing and transferability characteristics. Examples of the organic particles include all those particles that are typically used as external additives for the toner surface, including vinyl-based resins such as styrene-based polymers, (meth)acrylic polymers and ethylene-based polymers, polyester resins, silicone resins and fluororesins. These organic particles are added to improve the transferability, and typically have a primary particle size within a range from 0.05 to 1.0 μm. Lubricating agents may also be added. Examples of suitable lubricating agents include fatty acid amides such as ethylene bis-stearyl amide and oleyl amide, fatty acid metal salts such as zinc stearate and calcium stearate, and higher alcohols such as Unilin. These compounds are generally added to improve the cleaning properties, and typically employ compounds with a primary particle size within a range from 0.1 to 5.0 μm. Of the inorganic particles listed above, the addition of a hydrophobic-treated silica component to the toner of the present invention is desirable. It is also desirable that the primary particle size of the inorganic powder is within a range from 0.005 to 0.5 μm. A combination of silica-based particles and titanium-based particles is particularly preferred. From the viewpoint of ensuring favorable levels of transferability and developer lifespan, the combined use of inorganic or organic particles with volume average particle sizes within a range from 80 to 300 nm as external additives is desirable.

These external additives are subjected to mechanical impact together with the toner particles using a sample mill or Henschel mixer or the like, thereby adhering or fixing the additives to the surface of the toner particles.

[Electrostatic Latent Image Toner]

In a toner of an exemplary embodiment of the present invention, the quantity of saturated alkyl carboxylates containing from 3 to 5 carbon atoms within the toner particles is no more than 4 ppm. Furthermore, in a toner of another exemplary embodiment of the present invention, the quantity of alkyl propionates within the toner particles is no more than 4 ppm.

Furthermore, a toner of an exemplary embodiment of the present invention can be manufactured using the method of manufacturing an electrostatic latent image toner described above.

The aforementioned alkyl carboxylates containing from 3 to 5 carbon atoms such as alkyl propionates, alkyl butyrates and alkyl isobutyrates may be incorporated as compounds derived from polymerizable monomers having a vinyl-based double bond, including unsaturated carboxylate esters such as alkyl acrylates and alkyl methacrylates.

The volume average particle size of a toner of the present invention is preferably within a range from 3 to 10 μm, and even more preferably from 5 to 8 μm. Moreover, the number average particle size is preferably within a range from 3 to 8 μm, and even more preferably from 5 to 7 μm.

Measurements of the volume average particle size and the number average particle size can be conducted using a Coulter Multisizer-II (manufactured by Beckman Coulter, Inc.), by performing measurements at an aperture size of 100 μm. The toner is dispersed in an aqueous electrolyte solution (an isotonic aqueous solution) and dispersed for 30 seconds or more using ultrasound prior to conducting the measurement.

[Developer]

An electrostatic latent image toner of the present invention may either be used as is, as a one-component developer, or may also be used within a two-component developer. In those cases where the toner is used in a two-component developer, the toner is mixed with a carrier.

There are no particular restrictions on the type of carriers that can be used for the two-component developer, other than the characteristics required of the coating resin described below. Examples of suitable core materials include magnetic metals such as nickel and cobalt, magnetic oxides such as iron oxide, ferrite and magnetite, as well as resin-coated carriers having a resin coating layer on the surface of these core materials, and magnetic dispersed carriers. Furthermore, resin-dispersed carriers in which a conductive material is dispersed within a matrix resin are also suitable.

Examples of suitable coating resins or matrix resins for use in the carrier include polyethylene, polypropylene, polystyrene, polyvinyl acetate, polyvinyl alcohol, polyvinyl butyral, polyvinyl chloride, polyvinyl ether, polyvinyl ketone, vinyl chloride/vinyl acetate copolymers, styrene/acrylic acid copolymers, fluororesins, polyesters, polycarbonates, and epoxy resins, although this is in no way a restrictive list.

Examples of suitable conductive materials include metals such as gold, silver and copper, as well as carbon black, titanium oxide, zinc oxide, barium sulfate, aluminum borate, potassium titanate, and tin oxide, although this is in no way a restrictive list.

In order to use the carrier with a magnetic brush method, the carrier core material is preferably a magnetic material. The volume average particle size of the carrier core material is generally within a range from 10 to 500 μm, and is preferably within a range from 30 to 100 μm.

Moreover, in order to resin-coat the surface of the carrier core material, a method can be used which involves conducting coating with a coating layer-forming solution, in which the above coating resin, and if required various additives, are dissolved in an appropriate solvent. There are no particular restrictions on this solvent, which may be selected in accordance with the coating resin being used, and other factors such as the ease of application.

The carrier should generally exhibit a suitable electrical resistance, and specifically, electrical resistance values within a range from approximately $10^8$ to $10^{14}$ Ωcm are desirable. If the electrical resistance is low, such as the $10^6$ Ωcm observed for an iron powder carrier, then various problems can arise, including adhesion of the carrier to the image portion of the photoreceptor as a result of charge injection from the developing sleeve of the developing unit, or loss of the latent image charge through the carrier, which can cause distortions within the latent image and image defects. In contrast, if the insulating resin is coated overly thickly, then the electrical resistance value becomes too high, meaning the residual carrier charge following developing is more likely to be retained on the carrier surface, which leads to the occurrence of an edge effect, wherein although the edges of the images are crisp, the central portion of images with a large surface area suffer from extremely poor image density. Accordingly, it is desirable that a fine conductive powder is dispersed within the resin coating layer in order to enable regulation of the carrier resistance.

The carrier resistance is determined using a typical inter-electrode electrical resistance measurement method, wherein the carrier particles are sandwiched between two plate electrodes, and the current is measured on application of a voltage across the electrodes. The resistance is evaluated under an electric field of $10^{3.8}$ V/cm.

The electrical resistance of the conductive powder itself is preferably no higher than $10^8$ Ωcm, and values of $10^5$ Ωcm or smaller are particularly desirable. Specific examples of suitable conductive powders include metals such as gold, silver and copper, carbon black, simple conductive metal oxide systems such as titanium oxide and zinc oxide, and composite systems in which particles such as titanium oxide, zinc oxide, aluminum borate, potassium titanate and tin oxide are surface-coated with a conductive metal oxide. From the viewpoints of production stability, cost, and low electrical resistance, carbon black is particularly preferred. There are no particular restrictions on the type of carbon black used, although carbon blacks that exhibit favorable production stability and have a DBP (dioctyl phthalate) absorption within a range from 50 to 300 ml/100 g are ideal. The volume average particle size of the conductive powder is preferably no greater than 0.1 μm, and in order to ensure favorable dispersion, volume average particle sizes of 50 nm or smaller are particularly desirable.

Examples of suitable methods of forming the above resin coating layer on the surface of the carrier core material include immersion methods in which a powder of the carrier core material is immersed within a coating layer-forming solution, spray methods in which a coating layer-forming solution is sprayed onto the surface of the carrier core material, fluidized bed methods in which a coating layer-forming solution is atomized while the carrier core material is maintained in a floating state using an air flow, kneader coater methods in which the carrier core material and a coating layer-forming solution are mixed together in a kneader coater and the solvent is subsequently removed, and powder coating methods in which the coating resin is converted to fine particles, and is then mixed with the carrier core material in a kneader coater at a temperature higher than the melting temperature of the coating resin, and subsequently cooled. Of these methods, the use of kneader coater methods and powder coating methods is particularly favorable.

The average film thickness of the resin coating layer formed by any of the above methods is typically within a range from 0.1 to 10 μm, and is preferably from 0.2 to 5 μm.

The coating resin of the resin-coated carrier includes a resin for which the weight average molecular weight of the tetrahydrofuran (THF) soluble fraction is 30,000 or greater, and the component of this resin for which the weight average molecular weight is 10,000 or less is no higher than 30%. If the weight average molecular weight of the tetrahydrofuran (THF) soluble fraction is 30,000 or greater, and the component of the resin for which the weight average molecular weight is 10,000 or less is no higher than 30%, then degradation of the coating resin by saturated alkyl carboxylates formed from a carboxylic acid containing from 3 to 5 carbon atoms and an alkyl group containing from 3 to 5 carbon atoms can be more easily suppressed. The aforementioned THF-soluble fraction refers to the portion of the outer layer of the carrier coating that is dissolved on immersion within tetrahydrofuran (THF). Furthermore, the weight average molecular weight is measured using a gel permeation chromatography (GPC) method described below.

In the two-component developer described above, the mixing ratio (weight ratio) between the electrostatic latent image toner of an exemplary embodiment of the present invention and the carrier is typically within a range from approximately toner: carrier=1:100 to 30:100, and ratios from 3:100 to 20:100 are preferred.

[Image Formation Apparatus]

As follows is a description of an electrophotographic image formation apparatus equipped with an electrophotographic photoreceptor of the present invention, based on FIG. 1. The image formation apparatus 220 shown in FIG. 1 is an intermediate transfer type image formation apparatus, and contains four electrophotographic photoreceptors 401*a* to 401*d* (wherein, for example, the electrophotographic photoreceptor 401*a* is capable of forming a yellow image, the electrophotographic photoreceptor 401*b* is capable of forming a magenta image, the electrophotographic photoreceptor 401*c* is capable of forming a cyan image, and the electrophotographic photoreceptor 401*d* is capable of forming a black image) positioned in a mutually parallel arrangement along an intermediate transfer belt 409 inside a housing 400. The electrophotographic photoreceptors 401*a* to 401*d* installed in the image formation apparatus 220 each represent an electrophotographic photoreceptor of the present invention.

The electrophotographic photoreceptors 401*a* to 401*d* are each capable of rotating in a predetermined direction (in a counterclockwise direction within the plane of the drawing), and around this rotational direction there are provided charge rollers 402*a* to 402*d*, developing units 404*a* to 404*d*, primary transfer rollers 410*a* to 410*d*, and cleaning blades 415*a* to 415*d*. The four colored toners, namely the black, yellow, magenta and cyan toners housed within the toner cartridges 405*a* to 405*d* can be supplied to the developing units 404*a* to 404*d* respectively. Furthermore, the primary transfer rollers 410*a* to 410*d* contact the electrophotographic photoreceptors 401*a* to 401*d* respectively across the intermediate transfer belt 409.

A laser light source 403 (an exposure device) is also positioned at a predetermined location inside the housing 400, and the laser light emitted from the laser light source 403 is able to be irradiated onto the surfaces of the charged electrophotographic photoreceptors 401*a* to 401*d*. Accordingly, rotating the electrophotographic photoreceptors 401*a* to 401*d* enables the processes of charging, exposure, developing, primary transfer and cleaning to be conducted in sequence, thereby transferring and superimposing the toner image for each color onto the intermediate transfer belt 409.

The intermediate transfer belt 409 is supported at a predetermined level of tension by a drive roller 406, a backup roller 408 and a tension roller 407, and can be rotated without slack by appropriate adjustment of these rollers. A secondary transfer roller 413 is positioned so as to contact the backup roller 408 across the intermediate transfer belt 409. After passing between the backup roller 408 and the secondary transfer roller 413, the intermediate transfer belt 409 is surface-cleaned by a cleaning blade 416 positioned near the driver roller 406, and is then reused in the next image forming process.

Furthermore, a tray (a transfer target tray) 411 is provided at a predetermined positioned within the housing 400, and a transfer target 500 such as paper stored within this tray 411 is fed by feed rollers 412 between the intermediate transfer belt 409 and the secondary transfer roller 413, and then between two mutually opposing fixing rollers 414, before being discharged from the housing 400.

The above description presents a case in which the intermediate transfer belt 409 is used as the intermediate transfer material, but the intermediate transfer material may be either a belt-type material such as the aforementioned intermediate transfer belt 409 or a drum-shaped material. In those cases where a belt-shaped construction such as the intermediate transfer belt 409 is used as the intermediate transfer material, the thickness of the belt is preferably within a range from 50 to 500 μm, and is even more preferably from 60 to 150 μm, although this value may be appropriately selected in accordance with the hardness of the material. Furthermore, in those cases where a drum-shaped construction is used as the intermediate transfer material, the use of a cylindrical substrate formed from aluminum, stainless steel (SUS) or copper or the like as the base material is preferred. If required, an elastic layer may be formed on his cylindrical substrate, and a surface layer may then be formed on top of the elastic layer.

In the present invention, there are no particular restrictions on the transfer target, which may be any medium to which the toner image formed on the electrophotographic photoreceptor can be transferred. For example, in those cases in which the image is transferred directly from the electrophotographic photoreceptor to a piece of paper or the like, the paper is the transfer target, whereas in those cases where an intermediate transfer material is used, the intermediate transfer material functions as the transfer target.

An image forming method according to an exemplary embodiment of the present invention uses an image formation apparatus described above, and includes: charging a latent image holding member and the surface of that latent image holding member; forming a latent image on the charged surface of the latent image holding member; developing the latent image; transferring the developed toner image to a recording medium; and fixing the toner image on the recording medium, wherein either the electrostatic latent image toner or electrostatic image developer described above is used.

EXAMPLES

As follows is a description of the present invention based on a series of examples, although the present invention is in no way limited by these examples.

[Treatment of Polymerizable Monomer (1) Having a Vinyl-Based Double Bond]

40 parts by weight of a molecular sieve (a registered trademark) 4A (manufactured by Linde Co.) is added to 100 parts by weight of n-butyl acrylate (reagent grade, manufactured by Wako Pure Chemical Industries, Ltd.), the mixture is stirred for 1 minute at 500 rpm, subsequently left to stand for 5 minutes, and the n-butyl acrylate and molecular sieve (a registered trademark) 4A are then separated, thus yielding a polymerizable monomer (1) having a vinyl-based double bond.

[Treatment of Polymerizable Monomer (2) Having a Vinyl-Based Double Bond]

100 parts by weight of a molecular sieve (a registered trademark) 5A (manufactured by Linde Co.) is added to 100 parts by weight of n-butyl methacrylate (reagent grade, manufactured by Wako Pure Chemical Industries, Ltd.), the mixture is stirred for 1 minute at 500 rpm, subsequently left to stand for 5 minutes, and the n-butyl methacrylate and molecular sieve (a registered trademark) 5A are then separated, thus yielding a polymerizable monomer (2) having a vinyl-based double bond.

[Treatment of Polymerizable Monomer (3) Having a Vinyl-Based Double Bond]

500 parts by weight of a molecular sieve (a registered trademark) 13X (manufactured by Linde Co.) is added to 100 parts by weight of ethyl tiglate, the mixture is stirred for 1 minute at 500 rpm, subsequently left to stand for 5 minutes, and the ethyl tiglate and molecular sieve (a registered trademark) 13X are then separated, thus yielding a polymerizable monomer (3) having a vinyl-based double bond.

[Treatment of Polymerizable Monomer (4) Having a Vinyl-Based Double Bond]

50 parts by weight of a coconut husk-based activated carbon (Diasorb, manufactured by Mitsubishi Chemical Corporation) is added to 100 parts by weight of n-propyl acrylate (manufactured by Wako Pure Chemical Industries, Ltd.), the mixture is stirred for 1 minute at 500 rpm, subsequently left to stand for 5 minutes, and the n-propyl acrylate and coconut husk-based activated carbon are then separated, thus yielding a polymerizable monomer (4) having a vinyl-based double bond.

[Treatment of Polymerizable Monomer (5) Having a Vinyl-Based Double Bond]

40 parts by weight of a silica gel (Fuji Silica Gel Type A, manufactured by Fuji Silysia Chemical Ltd.) is added to 100 parts by weight of n-pentyl acrylate (manufactured by Wako Pure Chemical Industries, Ltd.), the mixture is stirred for 1 minute at 500 rpm, subsequently left to stand for 5 minutes, and the n-pentyl acrylate and silica gel are then separated, thus yielding a polymerizable monomer (5) having a vinyl-based double bond.

[Treatment of Polymerizable Monomer (6) Having a Vinyl-Based Double Bond]

0.001 parts of n-butyl propionate is added to 100 parts by weight of n-butyl acrylate (reagent grade, manufactured by Wako Pure Chemical Industries, Ltd.). 3 parts by weight of a molecular sieve (a registered trademark) 4A (manufactured by Linde Co.) is then added, the mixture is stirred for 1 minute at 500 rpm, subsequently left to stand for 5 minutes, and the n-butyl acrylate and molecular sieve (a registered trademark) 4A are then separated, thus yielding a polymerizable monomer (6) having a vinyl-based double bond.

[Preparation of Resin Particle Dispersion (1)]

| | |
|---|---|
| Styrene (guaranteed reagent grade, manufactured by Wako Pure Chemical Industries, Ltd.) | 78 parts by weight |
| Polymerizable monomer (1) having a vinyl-based double bond | 22 parts by weight |
| Acrylic acid (manufactured by Wako Pure Chemical Industries, Ltd.) | 2 parts by weight |
| Dodecanethiol (manufactured by Wako Pure Chemical Industries, Ltd.) | 1.5 parts by weight |

A solution is first prepared by mixing and dissolving the above components. A surfactant solution prepared by dissolving 4 parts by weight of an anionic surfactant (Dowfax A211, manufactured by The Dow Chemical Corporation) in 100 parts by weight of ion-exchanged water is placed in a flask, the 103.5 parts by weight of the above solution is then added to the flask and dispersed and emulsified, and 50 parts by weight of ion-exchanged water containing 3 parts by weight of ammonium persulfate dissolved therein is then added gradually while the dispersion in the flask is stirred slowly for 10 minutes. Subsequently, after flushing the system thoroughly with nitrogen, the flask is placed in an oil bath and the internal temperature of the system is heated to 68° C. with constant stirring, and the emulsion polymerization is then allowed to progress at this temperature for 5 hours, yielding a resin particle dispersion (1). Isolation of the resin particles from the resin particle dispersion and subsequent investigation of the physical properties reveals a center diameter of 200 nm, a solid fraction within the dispersion of 40%, a glass transition temperature of 52° C., an acid value of 14 mgKOH/g, and a weight average molecular weight Mw of 33,000.

[Preparation of Resin Particle Dispersion (2)]

With the exception of using the polymerizable monomer (2) having a vinyl-based double bond instead of the polymerizable monomer (1) having a vinyl-based double bond, a resin particle dispersion (2) is prepared in the same manner as the resin particle dispersion (1). The thus obtained resin particles have a center diameter of 200 nm, the solid fraction within the dispersion is 40%, the glass transition temperature is 54° C., the acid value is 16 mgKOH/g, and the weight average molecular weight Mw is 33,000.

[Preparation of Resin Particle Dispersion (3)]

With the exception of using 19 parts by weight of the polymerizable monomer (1) having a vinyl-based double bond and 3 parts by weight of the polymerizable monomer (3) having a vinyl-based double bond instead of the 22 parts by weight of the polymerizable monomer (1) having a vinyl-based double bond, a resin particle dispersion (3) is prepared in the same manner as the resin particle dispersion (1). The thus obtained resin particles have a center diameter of 210 nm, the solid fraction within the dispersion is 40%, the glass transition temperature is 53° C., the acid value is 22 mg KOH/g, and the weight average molecular weight Mw is 31,000.

[Preparation of Resin Particle Dispersion (4)]

With the exception of using the polymerizable monomer (4) having a vinyl-based double bond instead of the polymerizable monomer (1) having a vinyl-based double bond, a resin particle dispersion (4) is prepared in the same manner as the resin particle dispersion (1). The thus obtained resin particles have a center diameter of 230 nm, the solid fraction within the dispersion is 40%, the glass transition temperature is 56° C., the acid value is 19 mgKOH/g, and the weight average molecular weight Mw is 33,000.

[Preparation of Resin Particle Dispersion (5)]

With the exception of using the polymerizable monomer (5) having a vinyl-based double bond instead of the polymerizable monomer (1) having a vinyl-based double bond, a resin particle dispersion (5) is prepared in the same manner as the resin particle dispersion (1). The thus obtained resin particles have a center diameter of 210 nm, the solid fraction within the dispersion is 40%, the glass transition temperature is 50° C., the acid value is 25 mgKOH/g, and the weight average molecular weight Mw is 35,000.

[Preparation of Resin Particle Dispersion (6)]

With the exception of using the polymerizable monomer (6) having a vinyl-based double bond instead of the polymerizable monomer (1) having a vinyl-based double bond, a resin particle dispersion (6) is prepared in the same manner as the resin particle dispersion (1). The thus obtained resin particles have a center diameter of 220 nm, the solid fraction within the dispersion is 40%, the glass transition temperature is 52° C., the acid value is 29 mgKOH/g, and the weight average molecular weight Mw is 33,000.

[Preparation of Resin Particle Dispersion (7)]

With the exception of altering the quantity of acrylic acid to 0.5 parts by weight, a resin particle dispersion (7) is prepared in the same manner as the resin particle dispersion (1). The thus obtained resin particles have a center diameter of 280 nm, the solid fraction within the dispersion is 40%, the glass transition temperature is 52° C., the acid value is 3 mgKOH/g, and the weight average molecular weight Mw is 32,000.

[Preparation of Resin Particle Dispersion (8)]

With the exception of altering the quantity of acrylic acid to 8 parts by weight, a resin particle dispersion (8) is prepared in the same manner as the resin particle dispersion (1). The thus obtained resin particles have a center diameter of 180 nm, the solid fraction within the dispersion is 40%, the glass transition temperature is 53° C., the acid value is 54 mgKOH/g, and the weight average molecular weight Mw is 30,000.

[Colorant Dispersion 1]

| | |
|---|---|
| Carbon black (R330, manufactured by Cabot Corporation) | 50 parts by weight |
| Ionic Surfactant Neogen SC (manufactured by Dai-ichi Kogyo Seiyaku Co., Ltd.) | 5 parts by weight |
| Ion-exchanged water | 195 parts by weight |

The above components are mixed together and dissolved, dispersed for 10 minutes in a homogenizer (Ultra Turrax, manufactured by IKA Works Inc.), and then irradiated with ultrasound radiation of 28 kHz for 10 minutes using an ultrasound disperser, thereby yielding a colorant dispersion 1 with a solid fraction of 20% and a center particle diameter of 125 nm.

[Colorant Dispersion 2]

With the exception of altering the colorant to C.I. Pigment Yellow 74 (Seikafast Yellow 2054, manufactured by Dainichiseika Color & Chemicals Mfg. Co., Ltd.), a colorant dispersion 2 with a solid fraction of 20% and a center particle diameter of 150 nm is prepared in the same manner as the colorant dispersion 1.

[Colorant Dispersion 3]

With the exception of altering the colorant to C.I. Pigment Red 22 (Ket Red 302, manufactured by Dainippon Ink and Chemicals, Incorporated), a colorant dispersion 3 with a solid fraction of 20% and a center particle diameter of 135 nm is prepared in the same manner as the colorant dispersion 1.

[Colorant Dispersion 4]

With the exception of altering the colorant to C.I. Pigment Cyan 15:3 (PV Fast Blue, manufactured by Dainichiseika Color & Chemicals Mfg. Co., Ltd.), a colorant dispersion 4 with a solid fraction of 20% and a center particle diameter of 190 nm is prepared in the same manner as the colorant dispersion 1.

[Release Agent Dispersion]

| | |
|---|---|
| Polyethylene Wax (Polywax 725, melting temperature: 103° C., manufactured by Toyo Petrolite Co., Ltd.) | 50 parts by weight |
| Ionic Surfactant Neogen SC (manufactured by Dai-ichi Kogyo Seiyaku Co., Ltd.) | 5 parts by weight |
| Ion-exchanged water | 195 parts by weight |

The above components are heated to 120° C. and then subjected to a dispersion treatment using a pressure discharge Gaulin homogenizer, thereby yielding a release agent dispersion with a solid fraction of 20% and a center particle diameter of 226 nm.

(Method of Preparing Toner 1)

| | |
|---|---|
| Resin particle dispersion (1) | 285 parts by weight |
| Colorant dispersion 1 | 60 parts by weight |
| Release agent dispersion | 80 parts by weight |
| Polyaluminum chloride | 2.0 parts by weight |
| Ion-exchanged water | 1097 parts by weight |

The above components are mixed and dispersed thoroughly in a round-bottom stainless steel flask using a homogenizer (Ultra Turrax T50, manufactured by IKA Works Inc.), the flask is then heated to 47° C. under constant stirring using a heated oil bath, and this temperature of 47° C. is then maintained for 45 minutes, yielding an aggregate particle dispersion. 145 parts by weight of the above resin particle dispersion (1) is then added gradually to this aggregate particle dispersion, and the resulting mixture is left to stand for 30 minutes.

Subsequently, the pH of the system is adjusted to 6.5 by adding a 0.5 mol/liter aqueous solution of sodium hydroxide, the temperature is then raised to 96° C. with constant stirring, and after 1 hour, the pH is adjusted to 5.0 by adding a 1 mol/liter aqueous solution of nitric acid and then maintained under these conditions for 5 hours. Following cooling and filtering, an operation in which the toner is redispersed in 3 liters of ion-exchanged water and then subjected to a solid-liquid separation using Nutsche suction filtration is repeated 6 times, yielding a solid. This solid is then subjected to vacuum drying for 12 hours at 40° C., yielding toner matrix particles with a volume average particle size of 5.2 μm.

1.5 parts by weight of a hydrophobic silica (TS720, manufactured by Cabot Corporation) is then added to 100 parts by weight of the toner matrix particles, and the mixture is blended for 5 minutes at 3,000 rpm in a Henschel mixer, yielding a toner 1.

(Method of Preparing Toner 2)

With the exception of replacing the colorant dispersion 1 with the colorant dispersion 2, a toner is prepared in the same manner as the method of preparing the toner 1, thereby yielding a toner 2.

(Method of Preparing Toner 3)

With the exception of replacing the colorant dispersion 1 with the colorant dispersion 3, a toner is prepared in the same manner as the method of preparing the toner 1, thereby yielding a toner 3.

(Method of Preparing Toner 4)

With the exception of replacing the colorant dispersion 1 with the colorant dispersion 4, a toner is prepared in the same manner as the method of preparing the toner 1, thereby yielding a toner 4.

(Method of Preparing Toner 5)

With the exception of replacing the resin particle dispersion (1) with the resin particle dispersion (2), a toner is prepared in the same manner as the method of preparing the toner 1, thereby yielding a toner 5.

(Method of Preparing Toner 6)

With the exception of replacing the resin particle dispersion (1) with the resin particle dispersion (3), a toner is prepared in the same manner as the method of preparing the toner 1, thereby yielding a toner 6.

(Method of Preparing Toner 7)

With the exception of replacing the resin particle dispersion (1) with the resin particle dispersion (4), a toner is prepared in the same manner as the method of preparing the toner 1, thereby yielding a toner 7.

(Method of Preparing Toner 8)

With the exception of replacing the resin particle dispersion (1) with the resin particle dispersion (5), a toner is prepared in the same manner as the method of preparing the toner 1, thereby yielding a toner 8.

(Method of Preparing Toner 9)

With the exception of replacing the resin particle dispersion (1) with the resin particle dispersion (7), a toner is prepared in the same manner as the method of preparing the toner 1, thereby yielding a toner 9.

(Method of Preparing Toner 10)

With the exception of replacing the resin particle dispersion (1) with the resin particle dispersion (8), a toner is prepared in the same manner as the method of preparing the toner 1, thereby yielding a toner 10.

(Method of Preparing Toner 11)

With the exception of replacing the resin particle dispersion (1) with the resin particle dispersion (6), a toner is prepared in the same manner as the method of preparing the toner 1, thereby yielding a toner 11.

Carrier 1 Production Example

| | |
|---|---|
| Mn—Mg-based ferrite particles (absolute specific gravity: 4.6 g/cm$^3$, volume average particle size: 35 μm, saturated magnetization: 65 emu/g) | 100 parts by weight |
| Toluene | 11 parts by weight |
| Diethylaminoethyl methacrylate/styrene/methyl methacrylate copolymer (copolymerization ratio = 2:20:78, weight average molecular weight: 60,000, proportion of components with Mw of 10,000 or less: 25%) | 2 parts by weight |
| Carbon black (R330R, manufactured by Cabot Corporation) (volume average particle size: 25 nm, DBP value: 71 ml/100 g, resistance: no greater than 10 Ωcm) | 0.2 parts by weight |

All the above components with the exception of the ferrite particles are placed in a sand mill manufactured by Kansai Paint Co., Ltd. together with glass beads (particle size: 1 mm, same quantity as the toluene), and are mixed together for 30 minutes at a rotational speed of 1,200 rpm, thereby yielding a coating resin layer-forming solution. Subsequently, this coating resin layer-forming solution and the ferrite particles are placed in a vacuum deaeration type kneader, the mixture is stirred for 10 minutes with the temperature held at 60° C., and the pressure is then reduced to remove the toluene, thereby forming a resin coating layer and completing preparation of the carrier. The thickness of the resin coating layer is 1 μm. The carrier resistance under an electric field of $10^{3.8}$ V/cm is $4\times10^{10}$ Ωcm. The saturated magnetization value is obtained by measurement using a vibrating sample magnetometer (manufactured by Toei Industry Co., Ltd.), under conditions including an applied magnetic field of 3,000 (Oe).

Carrier 2 Production Example

With the exception of replacing the diethylaminoethyl methacrylate/styrene/methyl methacrylate copolymer from the carrier 1 production example with a diethylaminoethyl methacrylate/styrene/methyl methacrylate copolymer (copolymerization ratio=2:20:78, weight average molecular weight: 27,000, proportion of components with Mw of 10,000 or less: 33%), a carrier is prepared in the same manner as the method of preparing the carrier 1, thereby yielding a carrier 2.

Carrier 3 Production Example

With the exception of replacing the diethylaminoethyl methacrylate/styrene/methyl methacrylate copolymer from the carrier 1 production example with a diethylaminoethyl methacrylate/styrene/methyl methacrylate copolymer (copolymerization ratio=3:18:79, weight average molecular weight: 60,000, proportion of components with Mw of 10,000 or less: 26%), a carrier is prepared in the same manner as the method of preparing the carrier 1, thereby yielding a carrier 3.

[Preparation of Developers]

To 100 parts by weight samples of the above carrier 1 are added 7 parts by weight of each of the toners 1 through 11, and to 100 parts by weight samples of the carrier 2 and the carrier 3 is added 7 parts by weight of the toner 1, and each mixture is blended for 20 minutes in a V-type blender, and then filtered through a vibrating screen with a mesh size of 212 microns to remove any aggregate particles, thereby yielding a series of developers.

[Evaluation of Carrier Charge Deterioration]

Using a modified DocuCentre Color 400CP apparatus, manufactured by Fuji Xerox Co., Ltd. and shown in FIG. 1, each of the above developers is loaded into the developing unit, while supplementary toner is loaded into each of the toner cartridges. The modifications made to the apparatus involve setting the fixing temperature to 200° C. and setting the speed to 120 mm/s. The quantity of developing toner for the solid images of each color on the paper is adjusted to 7.0 $mg/m^2$, and following continuous output of 1,000 copies of full-page solid images, a solid image of dimensions 5 cm×5 cm is output, so that the portions outside this solid image are left as white paper. The print density of the solid image and the level of fogging into the white paper portions is then confirmed. The paper used is the brand "J-paper" manufactured by Fuji Xerox Office Supply Co., Ltd. The paper size is A4. Output is conducted for 50 cycles, with each cycle representing 200 pages, a total of 10,000 pages.

The evaluation criteria used are as shown below.

(Image Density)

A 1 g portion of the developer is removed from the developing unit, the weight ratio between the toner and the carrier is calculated using a 25 μm mesh, and the toner quantity is adjusted so that the toner: carrier weight ratio becomes 7:100. Specifically, if the toner quantity is too small relative to the carrier then additional toner is loaded into the developing unit, whereas if the toner quantity is too large, solid image printing without replenishment of the toner is used to consume the toner, thus adjusting the weight ratio. Using an X-Rite 404A device manufactured by X-Rite Corporation, the image density of a solid image of dimensions 5 cm×5 cm is then measured. The density is recorded as a percentage of the image density for the 1,000 copy relative to that of the first copy, and percentage values of 80% or lower are deemed problematic. The results following adjustment are shown in Table 1.

(Fogging into White Paper Portions)

The degree of fogging into the white paper portions outside of the solid image of dimensions 5 cm×5 cm used in the image density measurement is evaluated by visual inspection. The results are shown in Table 1.

[Evaluation of Toner for Existence of Saturated Alkyl Carboxylate Components Formed from a Carboxylic Acid Containing from 3 to 5 Carbon Atoms and an Alkyl Group Containing from 3 to 5 Carbon Atoms]

Quantitative Analysis of n-butyl propionate:

1 g of toner is weighed accurately, 10 ml of carbon disulfide is added to effect an extraction, and 1 microliter of the extracted liquid is injected into a gas chromatograph for analysis. The gas chromatograph used is a GC-17A manufactured by Shimadzu Corporation, and analysis is conducted under the conditions listed below.

Column: TC-1 60 m

Injection temperature: 200° C.

Conditions for temperature increase: 5 minutes at 40° C., then the temperature is raised to 140° C. at 4° C./minute Detector: FID The peak surface area for the peak corresponding with n-butyl propionate in the measured chromatogram is first determined for samples containing 1.0, 2.0, 4.0, 6.0, 8.0, 10.0, 12.0, 15.0 and 20.0 ppm respectively of n-butyl propionate, and the thus produced n-butyl propionate calibration curve is then used to determine the n-butyl propionate quantity within each of the toners.

Similar calibration curves are also prepared for propyl propionate, isobutyl propionate, pentyl propionate, isopentyl propionate, neopentyl propionate, propyl butyrate, butyl butyrate, isobutyl butyrate, pentyl butyrate, isopentyl butyrate, neopentyl butyrate, propyl isobutyrate, butyl isobutyrate, isobutyl isobutyrate, pentyl isobutyrate, isopentyl isobutyrate, neopentyl isobutyrate, propyl valerate, butyl valerate, isobutyl valerate, pentyl valerate, isopentyl valerate, neopentyl valerate, propyl isovalerate, butyl isovalerate, isobutyl isovalerate, pentyl isovalerate, isopentyl isovalerate, neopentyl isovalerate, propyl methylethylacetate, butyl methylethylacetate, isobutyl methylethylacetate, pentyl methylethylacetate, isopentyl methylethylacetate, neopentyl methylethylacetate, propyl pivalate, butyl pivalate, isobutyl pivalate, pentyl pivalate, isopentyl pivalate, and neopentyl pivalate, and a quantitative analysis is then conducted for each saturated alkyl carboxylate ester.

The saturated alkyl carboxylates measured for each of the toners 1 through 11, and the quantities of each of those alkyl carboxylates, are shown in Table 1.

Molecular weight measurements (referenced to polystyrene standards) are conducted using gel permeation chromatography (GPC). The GPC is conducted using devices HLC-8120GPC and SC-8020 (manufactured by Tosoh Corporation), two columns (TSKgel, Super HM-H, manufactured by Tosoh Corporation, 6.0 mmID×15 cm), and using THF (tetrahydrofuran) as the eluent. Testing is conducted under conditions including a sample concentration of 0.5%, a flow rate of 0.6 ml/minute, a sample injection volume of 10 μl, and a measurement temperature of 40° C., using an IR detector. Furthermore, the calibration curve is prepared using 10 polystyrene TSK standards manufactured by Tosoh Corporation: A-500, F-1, F-10, F-80, F-380, A-2500, F-4, F-40, F-128 and F-700.

Furthermore, the glass transition temperature (Tg) of each toner is measured by thermal analysis using a differential scanning calorimeter (DSC-7, manufactured by Shimadzu Corporation). Measurement is conducted from room temperature (25° C.) to 150° C. at a rate of temperature increase of 10° C. per minute, using nitrogen as the gas with a flow rate of 20 ml/minute, and the results are analyzed in accordance with the JIS standard (see JIS K-7121-1987).

The volume average particle size of each toner is measured using a Coulter Multisizer II (manufactured by Beckman Coulter, Inc.), using Isoton-II (manufactured by Beckman Coulter, Inc.) as the electrolyte.

The measurement method involves adding from 0.5 to 50 mg of the measurement sample to a surfactant as the dispersant (preferably 2 ml of a 5% aqueous solution of a sodium alkylbenzene sulfonate), and then adding this sample to 100 ml of the above electrolyte.

The electrolyte containing the suspended sample is subjected to dispersion treatment for 1 minute in an ultrasound disperser, the particle size distribution is measured for particles from 2 to 60 μm using an aperture size of 100 μm, and the volume average particle distribution and the number average particle distribution are determined. The number of particles measured is 50,000.

TABLE 1

| | Toner | Saturated alkyl carboxylate ester formed from a carboxylic acid containing from 3 to 5 carbon atoms and an alkyl group containing from 3 to 5 carbon atoms | | | Carrier | Evaluation | |
|---|---|---|---|---|---|---|---|
| | | Type | Quantity (ppm) | Total quantity (ppm) | | Image density | Fogging of white paper portions |
| Example 1 | 1 (black) | n-butyl propionate<br>isopropyl propionate | 1.6<br>0.2 | 1.8 | 1 | 96% | none |
| Example 2 | 2 (yellow) | n-butyl propionate<br>isopropyl propionate | 1.6<br>0.2 | 1.8 | 1 | 96% | none |
| Example 3 | 3 (magenta) | n-butyl propionate<br>isopropyl propionate | 1.6<br>0.2 | 1.8 | 1 | 96% | none |
| Example 4 | 4 (cyan) | n-butyl propionate<br>isopropyl propionate | 1.6<br>0.2 | 1.8 | 1 | 96% | none |
| Example 5 | 5 (black) | n-butyl isovalerate<br>isopropyl isovalerate | 2.6<br>0.6 | 3.2 | 1 | 82% | very slight |
| Example 6 | 6 (black) | n-butyl propionate<br>butyl methylethylacetate | 3.1<br>0.3 | 3.4 | 1 | 90% | none |
| Example 7 | 7 (black) | n-propyl propionate | 1.8 | 1.8 | 1 | 91% | none |
| Example 8 | 8 (black) | n-pentyl propionate | 2.3 | 2.3 | 1 | 89% | none |
| Example 9 | 9 (black) | isobutyl propionate | 3.6 | 3.6 | 1 | 86% | Too minor to cause problems |
| Example 10 | 10 (black) | n-butyl propionate<br>isopropyl propionate | 3.3<br>0.2 | 3.5 | 1 | 88% | Too minor to cause problems |
| Example 11 | 1 (black) | n-butyl propionate<br>isopropyl propionate | 1.6<br>0.2 | 1.8 | 2 | 84% | very slight |
| Example 12 | 1 (black) | n-butyl propionate<br>isopropyl propionate | 1.6<br>0.2 | 1.8 | 3 | 86% | Too minor to cause problems |
| Comparative example 1 | 11 (black) | n-butyl propionate | 8.1 | 8.1 | 1 | 73% | yes |

From the results in Table 1, the following observations are evident. Namely, using a toner of the present invention enables the production of a toner that exhibits uniform image density and is resistant to fogging at the image edges. In contrast, the toner of the comparative example shows no problems initially, but develops variation in the image density and fogging that are thought to be caused by damage to the surface of the resin-coated carrier, leading to a decrease in the chargeability of the carrier over time.

Potential applications of the present invention include application to image formation apparatus such as copying machines and printers that use an electrophotographic system For example, the present invention can be applied to a fixing device that fixes a non-fixed toner image supported on the surface of a recording sheet (paper).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic latent image toner, comprising resin particles, colorant particles and release agent particles, wherein a quantity within the toner of alkyl carboxylate esters formed from a carboxylic acid containing from approximately 3 to 5 carbon atoms and an alkyl group containing from approximately 3 to 5 carbon atoms is no more than approximately 4 ppm and the resin of the resin particles is formed by polymerizing a polymerizable monomer having a vinyl-based double bond.

2. The electrostatic latent image toner according to claim 1, wherein the carboxylic acid is propionic acid.

3. An image forming method, comprising: charging a latent image holding member and a surface of the latent image holding member; forming a latent image on the charged surface of the latent image holding member; developing the latent image; transferring the developed toner image to a recording medium; and fixing the toner image on the recording medium, wherein the method uses the electrostatic latent image toner according to claim 2.

4. The electrostatic latent image toner according to claim 1, wherein the electrostatic latent image toner comprises a release agent, the release agent has a subjective maximum endothermic peak, measured in accordance with ASTM D3418-8, within a range from approximately 60 to 120° C., and a melt viscosity at 140° C. within a range from approximately 1 to 50 mPas.

5. The electrostatic latent image toner according to claim 1, wherein a quantity of the release agent added to the electrostatic latent image toner is within a range from approximately 5 to 40% by weight.

6. The electrostatic latent image toner according to claim 1, wherein a shape factor SF1 is within a range from approximately 115 to 140.

7. The electrostatic latent image toner according to claim 1, wherein an acid value of a primary component resin is within a range from approximately 5 to 50 mgKOH/g.

8. The electrostatic latent image toner according to claim 1, wherein when the toner is measured using gel permeation chromatography, a molecular weight distribution represented by a ratio (Mw/Mn) between a weight average molecular weight (Mw) and a number average molecular weight (Mn) is within a range from approximately 2 to 30.

9. A method of manufacturing an electrostatic latent image toner according to claim 1, the method comprising: bringing a polymerizable monomer having a vinyl-based double bond into contact with a porous material; and producing a resin particle dispersion by polymerizing, in a water-based solvent, a polymerizable monomer that comprises the polymerizable monomer having a vinyl-based double bond, wherein the resin particle dispersion, a colorant particle dispersion produced by dispersing a colorant, and a release agent particle dispersion produced by dispersing a release agent are mixed together, and following formation of aggregate particles through aggregation of the resin particles, the colorant particles and the release agent particles, heating is conducted to fuse the aggregate particles and produce the electrostatic latent image toner.

10. An image forming method, comprising: charging a latent image holding member and a surface of the latent image holding member; forming a latent image on the charged surface of the latent image holding member; developing the latent image; transferring the developed toner image to a recording medium; and fixing the toner image on the recording medium, wherein the method uses the electrostatic latent image toner according to claim 1.

11. An electrostatic image developer, comprising an electrostatic latent image toner and a carrier, wherein the electrostatic latent image toner comprises resin particles, colorant particles and release agent particles, and wherein a quantity of alkyl carboxylate esters formed from a carboxylic acid containing from approximately 3 to 5 carbon atoms and an alkyl group containing from approximately 3 to 5 carbon atoms in the electrostatic latent image toner is no more than approximately 4 ppm.

12. The electrostatic image developer according to claim 11, wherein the carrier comprises a resin for which a weight average molecular weight of a tetrahydrofuran soluble fraction is approximately 30,000 or greater, and a component of the resin for which a weight average molecular weight is 10,000 or less is no higher than approximately 30%.

13. The electrostatic image developer according to claim 11, wherein an electrical resistance of the carrier is within a range from approximately $10^8$ to $10^{14}$ Ωcm.

14. The electrostatic image developer according to claim 11, wherein the carrier comprises a conductive powder.

15. The electrostatic image developer according to claim 14, wherein an electrical resistance of the conductive powder is no higher than approximately $10^8$ Ωcm.

16. The electrostatic image developer according to claim 14, wherein the conductive powder is carbon black.

17. The electrostatic image developer according to claim 16, wherein an absorption quantity for the carbon black is within a range from approximately 50 to 300 ml/100 g.

* * * * *